United States Patent [19]

Manor

[11] Patent Number: 4,512,517

[45] Date of Patent: Apr. 23, 1985

[54] IRRIGATION APPARATUS RETRACTILE INTO PIT

[76] Inventor: Ron Manor, 29 Shimoni St., Tel Aviv, Israel

[21] Appl. No.: 413,420

[22] Filed: Aug. 31, 1982

[51] Int. Cl.[3] ..... B05B 15/10

[52] U.S. Cl. ..... 239/206

[58] Field of Search ..... 239/201-206, 239/110, 111

[56] References Cited

U.S. PATENT DOCUMENTS

| | | | |
|---|---|---|---|
| 1,589,252 | 6/1926 | Sherman | 239/111 |
| 1,675,992 | 7/1928 | Sherman | 239/111 |
| 1,958,385 | 5/1934 | Sweetland | 239/204 |
| 2,901,183 | 8/1959 | Kohl | 239/205 |
| 3,033,467 | 5/1962 | Hofer | 239/204 |
| 3,301,489 | 1/1967 | Tropeano et al. | 239/204 |
| 4,026,471 | 5/1977 | Hunter | 239/206 |
| 4,145,003 | 3/1979 | Harrison et al. | 239/204 |

*Primary Examiner*—Andres Kashnikow
*Assistant Examiner*—Jon M. Rastello
*Attorney, Agent, or Firm*—John S. Roberts, Jr.

[57] ABSTRACT

An irrigation sprinkler or water gun is retracted into an underground pit during non-irrigation periods, while the pit is closed by a heavy cover which is simultaneously lowered onto the pit opening. The sprinkler is mounted on a telescopic lifting unit which is connected to a point of an underground water supply system and is raised by water pressure as soon as this system is pressurized. The sprinkler communicates with the telescopic unit through a pressure relief valve which is opened by the water pressure only after the sprinkler has been raised to its highest point above ground. As soon as this valve opens water is admitted to the sprinkler which starts to rotate and to irrigate the area.

1 Claim, 3 Drawing Figures

IRRIGATION APPARATUS RETRACTILE INTO PIT

BACKGROUND OF THE INVENTION

The invention relates to an agricultural irrigation system consisting of a plurality of rotatable retractile sprinklers or water guns which are adapted to be submerged in covered pits when not in use, and to be projected out of these pits to a height above the plants in the field, during irrigation periods. The invention further relates to a method of actuating one or more sprinklers out of the total number installed in the field, from a central point servicing a larger number of irrigated areas.

Sprinkler irrigation of large planted areas is, up to date, carried out by different methods, each having its advantages and drawbacks, such as:

(1) Laying of a temporary system of pipe lines above ground with a plurality of sprinklers installed at predetermined intervals, and removing the pipes and sprinklers after the irrigation period, for the purpose of harvesting the produce and tilling the soil for the next crop. Although this method permits full use of the entire area for planting or sowing, it requires much manual work which is costly and time-consuming. In addition, it results in rapid wear and tear owing to rough handling and during storage.

(2) Laying a permanent system of underground pipe lines of aluminum or plastic with risers projecting above ground at predetermined intervals and mounting sprinklers onto the risers during each irrigation period. The sprinklers are removed during harvesting and soil tillage, in order not to be damaged by the agricultural machinery, and in order not to interfere with the work. In spite of the removal of the sprinklers, there remains a narrow strip along each pipe line and the risers, which cannot be utilized, since ploughing and tilling along these strips can lead to damage to both the piping and the agricultural implements.

(3) The same applies to an underground pipe system with permanently fixed sprinklers, with the additional drawback that the strips of non-workable soil are wider and that the danger of damage to the sprinklers is augmented.

(4) Mobile irrigation equipment of different design has been introduced lately and has found great acclaim, as for instance "Center-post" irrigation machinery, as well as ground-supported carriers advanced along an irrigation zone across a field. The great advantage of these machines is the possibility of using the entire area for tilling and planting, since there are no permanent obstacles to the passage of agricultural machines. Their main drawback is the high cost of the equipment, high maintenance costs and the requirement of constant supervision, in contradistinction to stationary irrigation equipment which can be fully automated.

In view of the aforesaid it is one object of the invention to instal a system of underground sprinklers or water guns which are completely covered during non-irrigation periods, so as to permit agricultural machinery to travel freely over the entire field area, thus making all areable land suitable for planting and sowing.

It is another object to permit the operation of only a limited number of sprinklers during a certain period, dependent on the available water flow, and of another set of sprinklers during the following period, signals for operation being given from a central point afar from the irrigated area.

It is still another object of the invention to permit full automation with regard to the opening and closing of individual sprinklers in accordance with the humidity of the soil or other factors, as signalled by tensiometers or other instruments.

SHORT DESCRIPTION OF THE INVENTION

According to the invention an area to be irrigated is provided with an undergound pipe system connected to a plurality of preferably equidistant retractile sprinklers or water guns. Each sprinkler is positioned in an underground solid pit, preferably made of concrete, which has an open top and a bottom which is closed except for drainage openings. The irrigation apparatus comprises a sprinkler or water gun, of known design, rotatably mounted on the top outlet of a pressure relief valve adjusted so as to open at a predetermined pressure and to supply water at this pressure to the sprinkler. The bottom inlet side of the pressure relief valve is connected to the upper end of a substantially vertical telescopic lifting unit consisting of an inner tube adapted to be moved in an outer tube of larger diameter, the latter tube being stationary and vertically fixed in the bottom of the pit. An upper and a lower cylindrical sleeve are provided in the annular space between the two tubes, the upper sleeve being attached to the outer tube and the lower sleeve to the inner tube. They serve as guides for the smooth movement of the inner tube in the outer tube and as limiting stops of the upward movement of the inner tube. The respective upper ends of the two tubes are tightly attached to the two ends of an axially expandable bellows, serving to prevent water from escaping from the top of the unit into the pit.

The bottom end of the outer tube communicates with a point of the underground pipe system through a hydraulically operated supply valve, while the inner space at the top of the telescopic unit communicates with the atmosphere through an hydraulically operated drain valve; both valves are hydraulically connected to a control station by means of—likewise underground—small-diameter piping. The two hydraulic valves are adjusted in such a manner that the supply valve opens and that the drain valve is closed upon application of pressure upon their respective monitoring mechanism, and that the supply valve closes and the drain valve opens upon cessation of pressure.

A flat and reinforced cover corresponding in outline to the top opening of the pit is mounted on top of the sprinkler body, spaced-apart from the nozzle, and is adapted to firmly cover the pit while the sprinkler is retracted into the pit, and to be raised above ground together with the sprinkler by operation of the telescopic lifting unit.

In a preferred embodiment of the telescopic unit a helical spring is positioned in the space between the two tubes and the two sleeves, serving as shock absorber at the end of the upward travel of the sprinkler. Operation of the irrigation unit is as follows: In order to raise the sprinkler out of the pit, pressure is applied to the main and the auxiliary valves, whereby the supply valve at the bottom of the telescopic unit is opened and water under pressure is admitted into the telescopic unit; the same pressure closes the drain valve thus keeping the space in the telescope under full pressure. The pressure acts on the—still close—pressure relief valve positioned on top of the inner tube, thus raising this tube, together with the sprinkler and the pit cover, to a height above the top of the plants in the field. As soon as the uppermost position of the sprinkler is reached as defined by the contact between the sleeves, pressure rises in the tubes until it reaches the magnitude at which the pressure relief valve opens and admits water to the sprinkler nozzle. Water ejection through the nozzle starts rotation of the sprinkler body whereby water is distributed in a circle dependent on the reach of the water jet. The pit cover—which is likewise raised above the nozzle—either rotates together with the sprinkler body or remains at rest since connection between sprinkler and cover is advantageously made through a ball bearing. Whenever the irrigation process is to be terminated, pressure to the two hydraulic valves is released, causing the supply valve at the bottom to close and to shut off the water supply to the sprinkler, and the drain valve to open, causing the inner space of the telescopic unit to communicate with the atmosphere and water to flow out of the tubes into the pit. This in turn, causes the sprinkler and the cover to descend since no counterpressure prevails, and to drive water out of the telescopic unit through the drain valve. This descent continues until the cover contacts the top of the pit and closes the latter. After the entire area has been sufficiently irrigated, all sprinklers are being automatically retracted into their respective pits, and the covered pits permit the passage of agricultural machinery across the entire field aea.

SHORT DESCRIPTION OF THE DRAWINGS

FIG. 1 is a vertical section through a pit and a telescopic unit, showing a sprinkler and a pit cover in retracted position, FIG. 2 is an elevation, on an enlarged scale, of the sprinkler and the pit cover illustrated in FIG. 1, and FIG. 3 is an enlarged vertical section of the telescopic unit illustrated in FIG. 1.

DESCRIPTION OF A PREFERRED EMBODIMENT OF THE INVENTION

Figure 1:
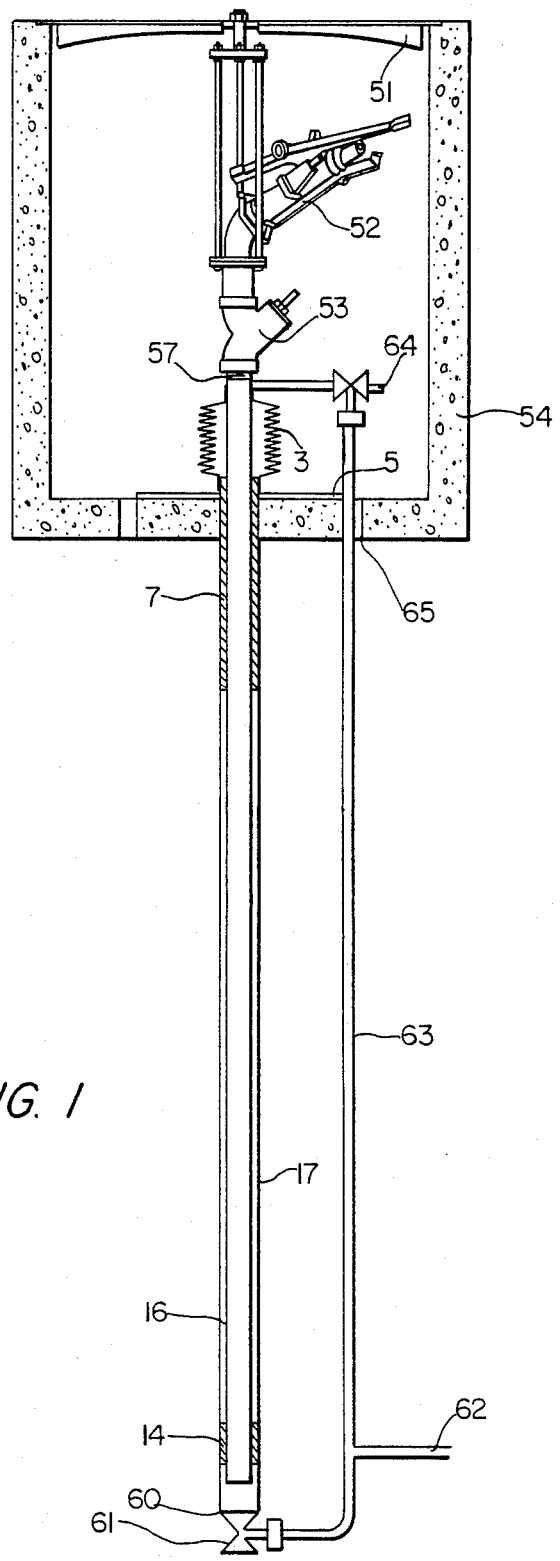
Figure 2:
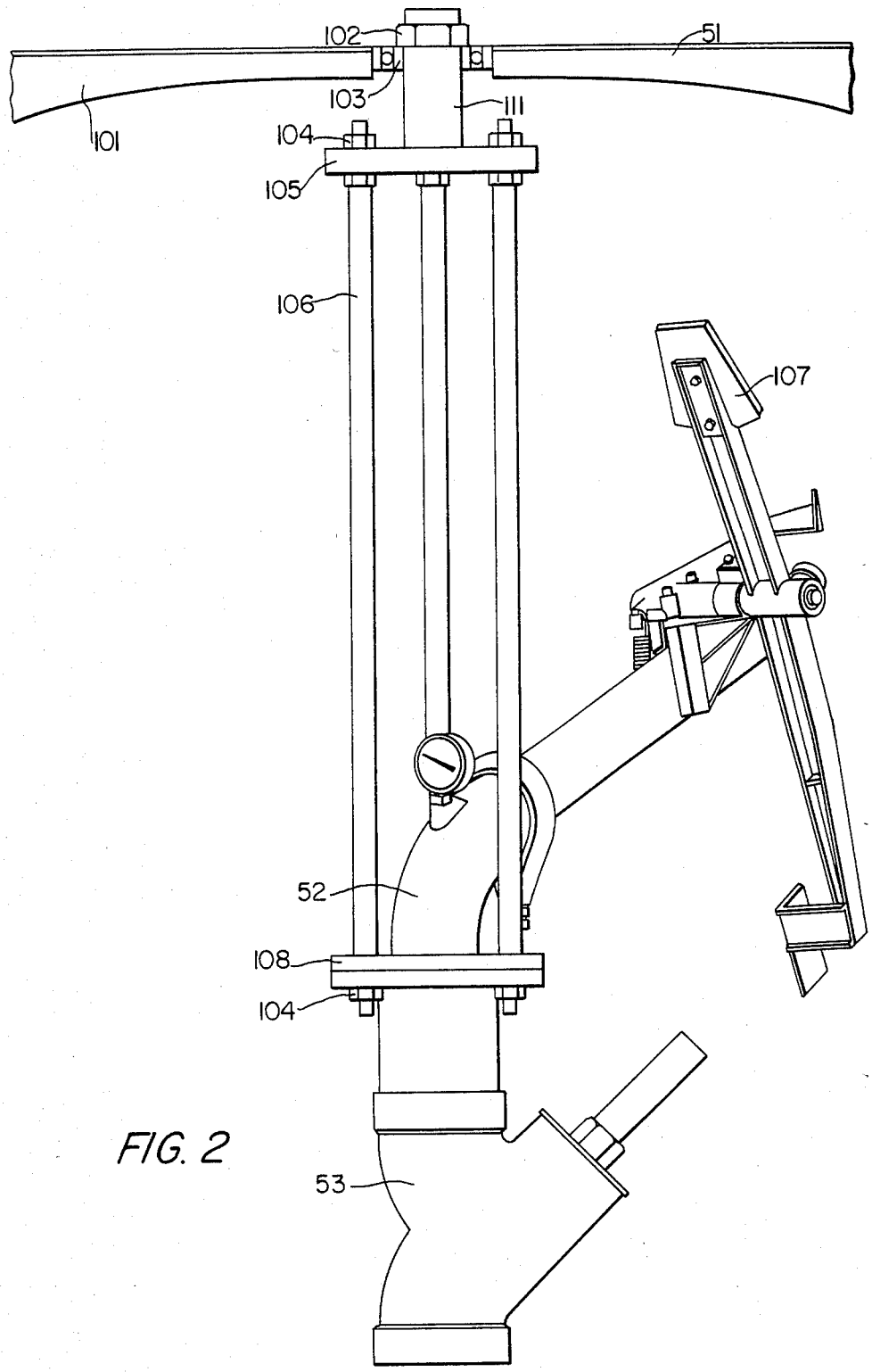

With references to FIGS. 1 and 2 of the drawings a rotary sprinkler or water gun 52 of any known make is mounted on top of a pressure relief valve 53. This valve is screwed onto the top of the inner tube 16 of a telescopic lifting unit, the inner tube being moved by water pressure within an outer tube 17. The sprinkler 52 is provided, in accordance with standard design, with a flange 108 rotating at the same rate, and a pit cover 51 is connected to this flange, by means of a stand comprising standards 106, a top plate 105, a central pin 111 and a ball bearing 103. The pit cover 51 is reinforced, on its underside, by a number of perpendicular ribs 101, which also serve as wind brakes against rotation of the cover which thus is at relative standstill while the sprinkler rotates. The outer tube 17 of the telescopic unit is fastened to the bottom of a pit 54 by means of a base plate 5; the pit is of circular or square cross section and is preferably cast in concrete; it is open at its top and closed at its bottom, except for drain holes 65 which penetrate the bottom.

The pressure relief valve 53 is of the kind which remains closed until a predetermined pressure acts on the valve disc from below, whereupon the disc opens fully permitting a full water flow therethrough. The valve closes, after the pressure has dropped below the opening pressure.

A pressure-operated supply valve connects the outer tube 17 with an underground water supply system and is monitored by pressure admitted to it through small-diameter control piping 62, 63, also laid underground. A drain valve 64 of similar design connects the upper end of the inner tube of the telescopic unit with the atmosphere; the purpose of these valves will be described further on.

Figure 3:
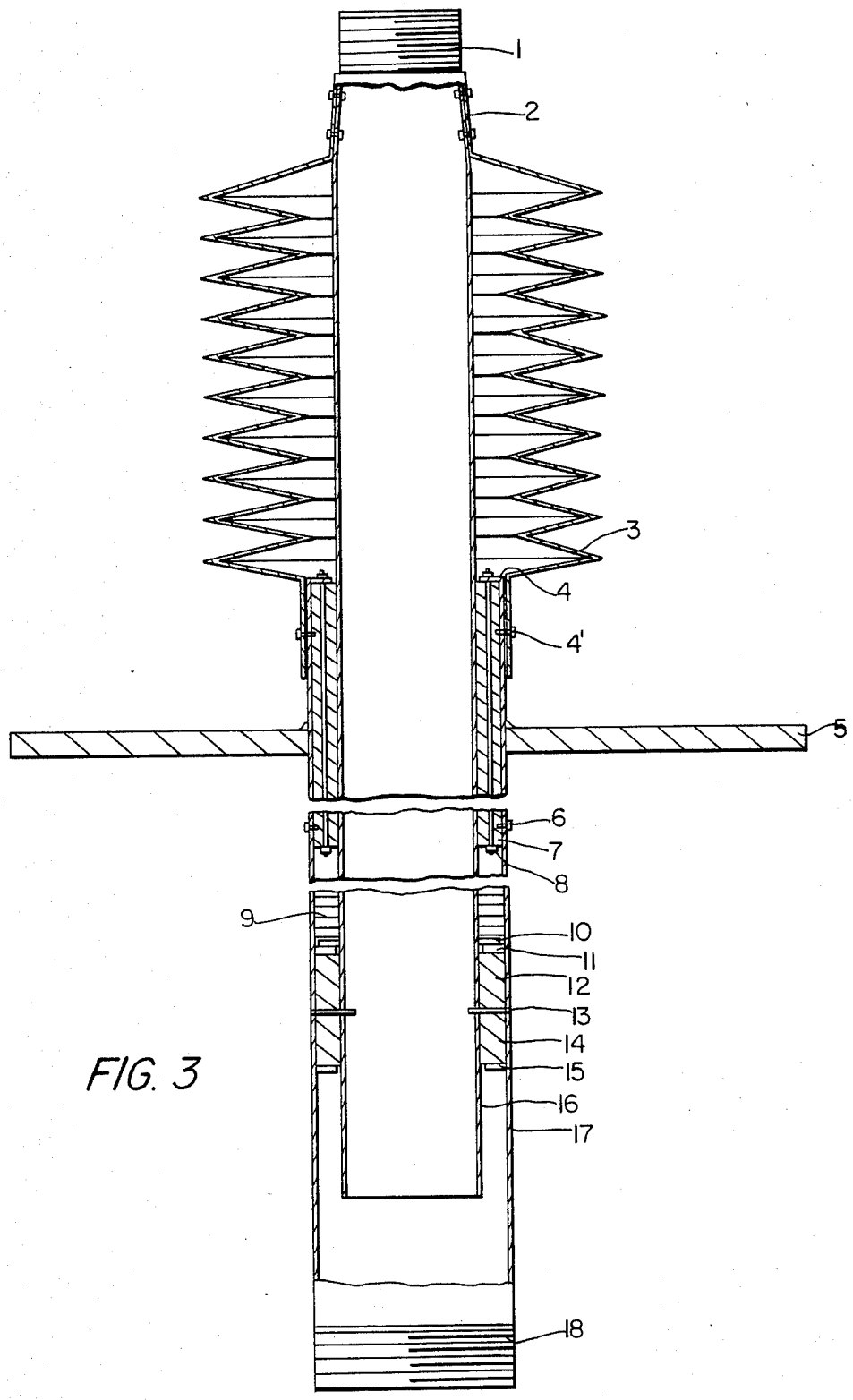

FIG. 3 illustrates the telescoping lifting unit of FIG. 1, showing more details of its construction. The inner tube 16 is movable in the outer tube 17 and is guided by means of an upper sleeve 7 rigidly attached to the upper end of the outer tube and a lower sleeve 14 rigidly attached to the lower portion of the inner tube. The upper ends of each of the inner and the outer tubes are tightly attached to the respective upper and lower end of an axially expandable bellows 3 which serves to retain the pressure in the telescopic unit and to prevent water from escaping into the pit. A flat helical spring 9 is positioned in the space between the two tubes, on top of the lower sleeve, serving as shock absorber between the two sleeves (7, 14) at the end of each raising operation.

The irrigation unit may be operated in two different ways:

(1) It is presumed that only a given number of sprinklers out of the total in a large area are to be actuated, and that the entire underground water supply system is supplied with water at the required irrigation pressure, e.g. 5–6 bar. All irrigation units are connected to a central control station by means of small-diameter piping 62, either by individual pipes leading to each unit, or by one pipe each connecting a group of sprinklers which are to be operated simultaneously. Opening of the supply valves 53 is performed by admitting pressure through piping 62, which also serves to close the drain valves 64. This action admits water under pressure into the telescopic unit, the pressure acting on the—still closed—pressure relief valve 53 until the cover 51 and the sprinkler 52 are raised above the height of the plants in the field, defined by the distance between the upper and lower sleeves 7 and 14.

The upwardly movement is relatively fast, and in order to avoid sudden deceleration, the spring 9 damps the otherwise hard contact between the two sleeves. As soon as the upper limit has been reached the pressure rises in the telescope and opens the pressure relief valve 53 which is set to open at a pressure lower than the full irrigation pressure, e.g. 4 bar. The valve 53 is kept fully open by the pressure, and water emerges through the nozzle of the sprinkler and rotates the latter in a known manner by hammer action on a swing arm 107.

Shutting off of the unit is performed by reducing the pressure in the control piping 62, causing the supply valve 55 to close and the drain valve 64 to open. The opening of the drain valve releases the pressure in the telescopic unit, and the sprinkler and the pit cover start to descend and, owing to their weight, to expel the water out of the tubes 16, 17 into the pit, until the cover 51 comes to rest on the rim of the pit.

The cover is to be made strong enough to permit the passage of agricultural tractors and agricultural implements across the pit, whereby the entire area of the field lends itself to cultivation.

(2) Presuming that all irrigation units (sprinklers) in a given area to be actuated simultaneously, then the pressure-operated supply valve 53 and drain valve 64, as well as the control piping 62, 63 can be dispensed with.

In this case the underground water supply system is set under full pressure from a central control station, whereby all sprinklers are raised out of their pits, as described in the foregoing. Shutting off the water supply will terminate irrigation, but in addition it is necessary to open a central drain valve for the purpose of reducing the pressure in the piping and in the irrigation units down to atmosphering pressure, causing the sprinklers and pit covers to descend by their own weight.

It will be understood that the construction of the irrigation unit may undergo modifications and alterations at the hand of a person skilled in the art, without however deviating from the spirit of the invention.

It is, for instance, not necessary to mount the pit cover direct on the rotary sprinkler, but to connect it to the top of the telescopic unit by means of vertical supports positioned close to the wall of the pit, outside the diameter covered by the sprinkler nozzle. This will hardly interfere with the water distribution, since the jet will be interrupted in two narrow spots only. Instead of positioning the drain valve (64) at the top of the inner tube, this valve may be connected to the inlet portion of the pressure relief valve (53) with the same effect of reducing the pressure in the system and to drain water out of it during descent of the sprinkler.

The pit is not necessarily of concrete, but may be built of brick or other building material as long as it is strong enough to support the weight of a crossing tractor.

The advantages of submerged irrigation units have been described in the introduction, and it is, therefore not necessary to reiterate them here.

I claim:

1. Sprinkler irrigation apparatus adapted to be retracted into an open-top underground pit, to be raised out of the pit by water pressure, and to eject water only after having been elevated above the plants to be irrigated, the apparatus comprising:

a hydraulically operated vertical telescopic lifting unit consisting of an outer tube rigidly fastened in the bottom of said pit and having its bottom end connected to an underground water supply system, and an inner tube vertically movable in and along said outer tube, the respective upper ends of said tubes being tightly attached to the two ends of an axially expandable bellows; a vertically positioned pressure relief valve of the kind adapted to be wide opened upon being exposed to water pressure one or two bar below the pressure in said water supply acting on its inlet side, its inlet end being tightly connected to the top of said inner tube; a rotary sprinkler or water gun of known design mounted on the outlet end of said pressure relief valve, the diameter described by the rotating nozzle of said sprinkler being smaller than the inner contour of said pit; a flat cover positioned above said sprinkler of a dimension permitting its closing the top opening of said pit, said cover being attached to the top of said telescopic unit and being adapted to be raised above ground together with said sprinkler; a pressure-operated valve of the kind to be opened by pressure applied to its actuating mechanism, positioned between said outer tube and said underground water supply; a pressure operated drain valve adapted to be closed by pressure applied to its actuating mechanism connected at its one end to the portion of said inner tube, and at the other end to the atmosphere; a remote control station communicating with said pressure-operated supply valve and said pressure-operated drain valve through piping, said control station serving to open said supply valve and to close said drain valve by pressure supplied through said piping whenever the irrigation apparatus is to be operated, and to close said supply valve and to open said drain valve by non-pressure supply, in order to stop water supply to said sprinkler and to lower it into said pit.

* * * * *